US006926018B1

(12) United States Patent
Ryo

(10) Patent No.: US 6,926,018 B1
(45) Date of Patent: Aug. 9, 2005

(54) HANDS FREE UMBRELLA

(76) Inventor: U Yun Ryo, 2716 MArtinique La., Lexington, KY (US) 40509

( * ) Notice: Subject to any disclaimer, the term of this patent is extended or adjusted under 35 U.S.C. 154(b) by 67 days.

(21) Appl. No.: 10/601,112

(22) Filed: Jun. 23, 2003

(51) Int. Cl.[7] ..... A45B 11/02

(52) U.S. Cl. ..... 135/15.1; 135/16; 248/511; 224/186; 224/660

(58) Field of Search ..... 135/15.1, 16; 248/511, 248/534; D3/12, 13; 224/186, 242, 271, 224/200, 603, 605, 666, 660, 673

(56) References Cited

U.S. PATENT DOCUMENTS

| | | | | | |
|---|---|---|---|---|---|
| 595,218 | A | * | 12/1897 | Stauffer | 224/186 |
| 903,682 | A | * | 11/1908 | Cumpston | 224/190 |
| 1,657,263 | A | * | 1/1928 | Lauby | 224/188 |
| 1,755,209 | A | * | 4/1930 | Danner | 224/186 |
| 2,166,562 | A | * | 7/1939 | Staley | 135/15.1 |
| 3,554,203 | A | | 1/1971 | Hall | |
| 3,705,592 | A | * | 12/1972 | Weber | 135/25.4 |
| 3,892,251 | A | | 7/1975 | Warfield | |
| 4,188,965 | A | * | 2/1980 | Morman | 135/16 |
| 4,856,546 | A | * | 8/1989 | Kummunsalo | 135/15.1 |
| 4,967,943 | A | | 11/1990 | Massey | |
| 5,105,574 | A | * | 4/1992 | Fast | 43/21.2 |
| D327,166 | S | * | 6/1992 | Barker | D3/13 |
| 5,353,977 | A | * | 10/1994 | Schiro et al. | 224/251 |
| 5,431,364 | A | * | 7/1995 | Etter | 248/514 |
| D361,654 | S | | 8/1995 | Petracco | |
| 5,513,786 | A | | 5/1996 | Drane | |
| 5,918,612 | A | | 7/1999 | Hughes | |
| 6,015,077 | A | | 1/2000 | Disher | |
| 6,619,521 | B2 | * | 9/2003 | Hadley | 224/190 |

* cited by examiner

*Primary Examiner*—Robert Canfield

(57) ABSTRACT

A hands free umbrella includes an umbrella having a pole that has a bottom end and a top end. A canopy is attached to the top end of the pole. A handle is attached to the bottom end of the pole and extends downwardly away therefrom. The handle has a bottom side, a top side and a peripheral side wall extending between the top and bottom sides. The handle is substantially solid. A securing member for releasably attaching the handle to a belt is positioned on the handle.

7 Claims, 3 Drawing Sheets

HANDS FREE UMBRELLA

BACKGROUND OF THE INVENTION

1. Field of the Invention

The present invention relates to umbrella devices and more particularly pertains to a new umbrella device for which is attachable to a torso of a person so that the person is covered by the umbrella.

2. Description of the Prior Art

The use of umbrella devices is known in the prior art. U.S. Pat. Nos. 5,918,612 and 3,892,251 describes the general trend of umbrella devices, which include hands-free construction. These devices employ harnesses, which are positioned around the body and attached to an umbrella. While these devices fulfill their respective, particular objectives and requirements, the need remains for a hands-free umbrella system that is simpler to use and is less constraining on the user of the umbrella.

SUMMARY OF THE INVENTION

The present invention meets the needs presented above by attaching a securing member to the handle of the umbrella for releasably securing the handle to the belt or upper edge of the pants of the user of the umbrella. This allows the belt to do the majority of the lifting of the umbrella without the addition of a harness.

Another object of the present invention is to provide a new umbrella device that also includes a strap for those persons who require additional stability of the umbrella.

To this end, the present invention generally comprises an umbrella including a pole that has a bottom end and a top end. A canopy is attached to the top end of the pole. A handle is attached to the bottom end of the pole and extends downwardly away therefrom. The handle has a bottom side, a top side and a peripheral side wall extending between the top and bottom sides. The handle is substantially solid. A securing member for releasably attaching the handle to a belt is positioned on the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
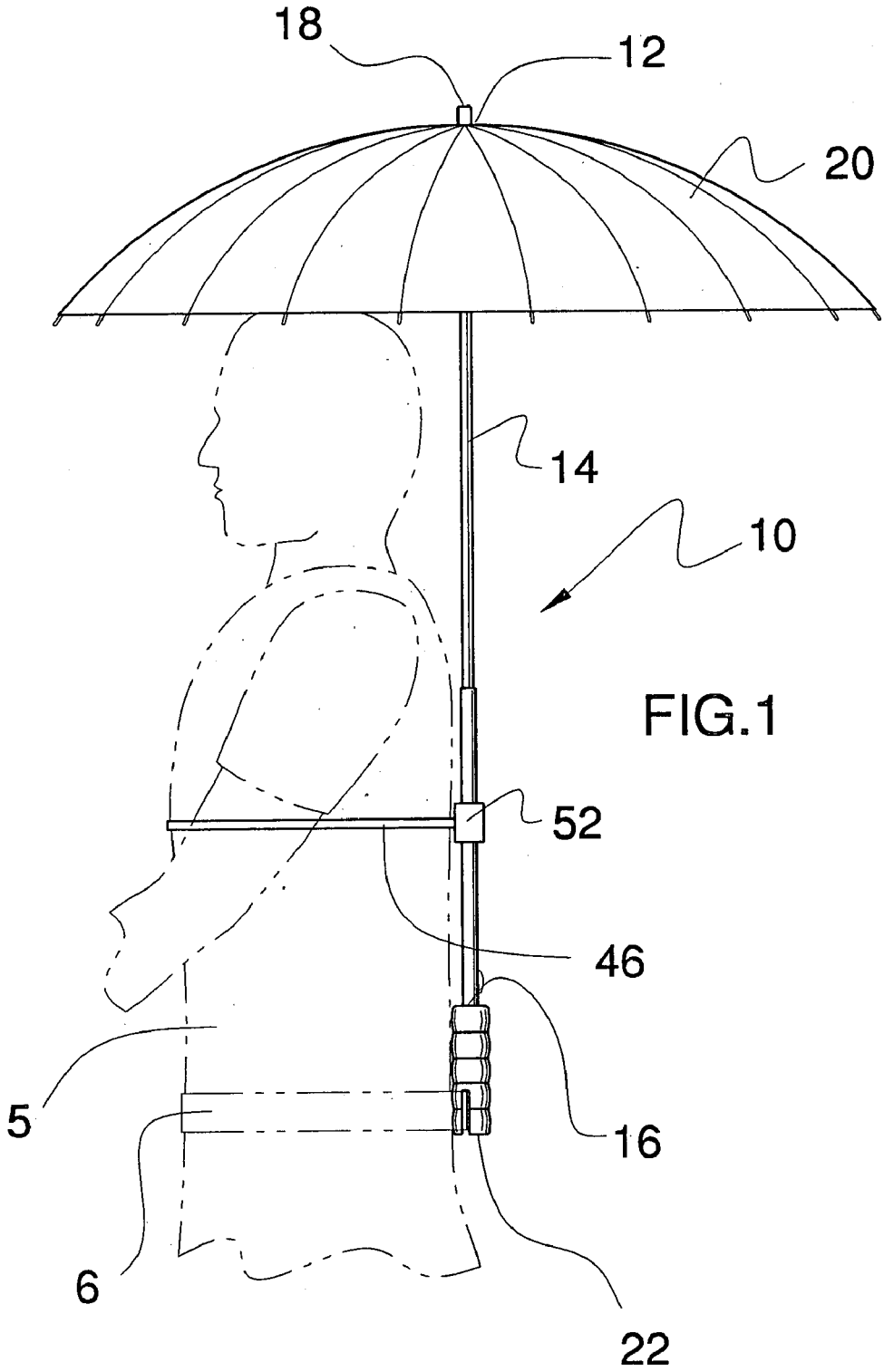
FIG. 1 is a schematic side view of a hands free umbrella according to the present invention.
Figure 2:
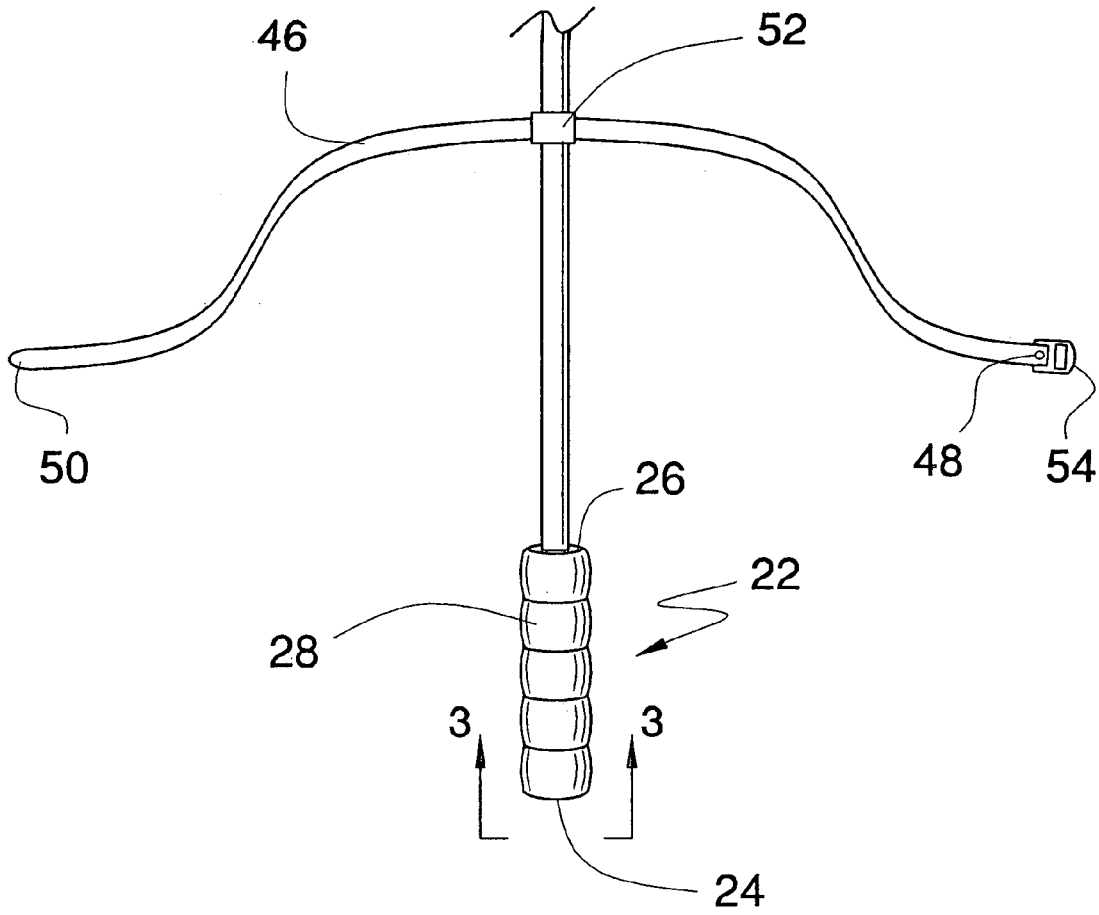
FIG. 2 is a schematic front perspective view of the present invention.
Figure 3:
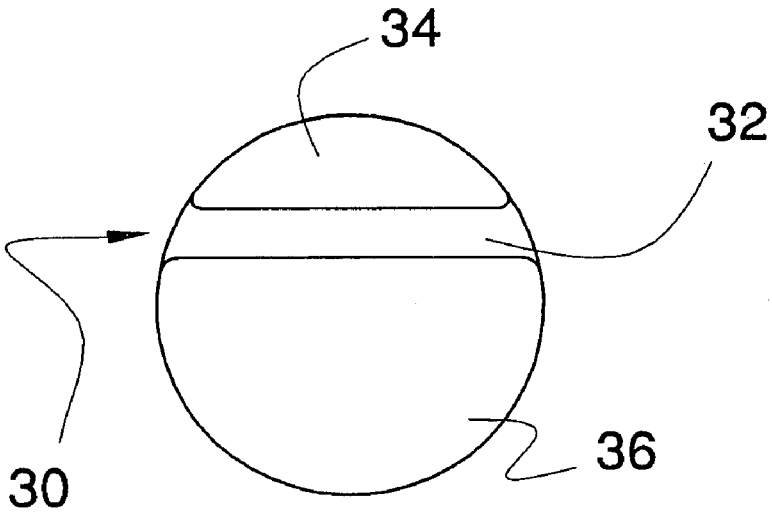
FIG. 3 is a schematic bottom view taken along line 3—3 of FIG. 2 of the present invention.

With reference now to the drawings, and in particular to FIGS. 1 through 4 thereof, a new umbrella device embodying the principles and concepts of the present invention and generally designated by the reference numeral 10 will be described.

As best illustrated in FIGS. 1 through 4, the hands free umbrella 10 generally comprises an umbrella 12 including a pole 14 having a bottom end 16 and a top end 18. A canopy 20 is attached to the top end 18 of the pole 14. The umbrella 14 is conventional in all respects except for a handle 22. For that reason, it is assumed that the canopy 20 is selectively collapsible and the pole 14 may or may not be telescoping.

The handle 22 is attached to the bottom end 16 of the pole 14 and extends downwardly away therefrom. The handle 22 has a bottom side 24, a top side 26 and a peripheral side wall 28 extending between the top 26 and bottom 24 sides. The bottom side 24 has a generally circular shape. The handle 22 is substantially solid, as opposed to being hollow. A securing member 30 for releasably attaching the handle 22 to a belt 6 is positioned on the handle 22. Preferably, the securing member 30 is formed by a slit 32 transversely extending through the bottom side 24 such that the slit 32 extends through peripheral side wall 28 and a first portion 34 and a second portion 36 of the bottom side 24 is defined. The slit 32 extends at least one inch upwardly from the bottom side 24'. The first portion 34 has a smaller surface area than the second portion 36. The belt 6, or upper edge of pants, positioned around a person 5 using the umbrella 12 may be extended into the slit 32. The first portion 34 would be positioned adjacent to the person 5. Because the first portion 34 is smaller than the second portion 36, it is more comfortable when placed against the person 5 and will pull less on the belt 6 or pants.

Figure 4:
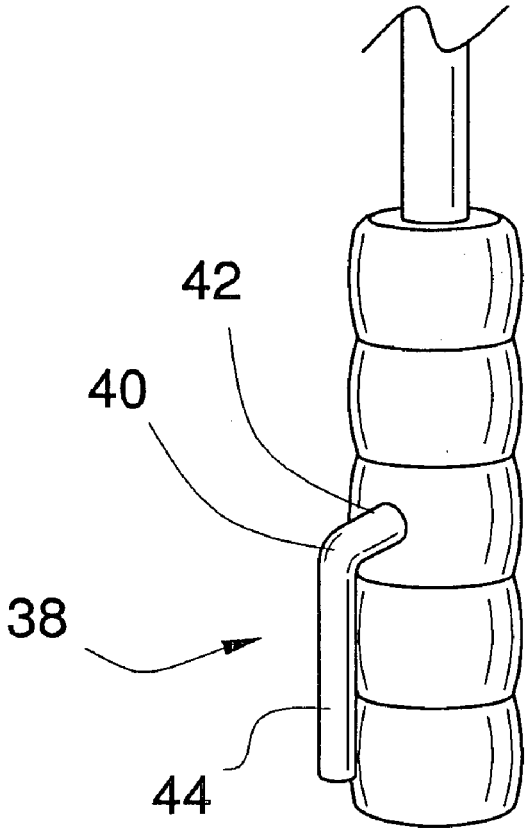
FIG. 4 is a schematic perspective view of the second embodiment of the present invention.

A second embodiment of the securing member 38 is shown in FIG. 4. The securing member 38 of this embodiment includes a hook 40 having an arm portion 42 and a leg portion 44 attached together at a generally perpendicular angle so that the hook 40 is L-shaped. An end of the arm portion 42 is attached to the peripheral side wall 28 of the handle 22 so that the leg portion 44 extends downwardly away from the pole 14. The leg portion 44 may be extended between the belt 6 and the person 5 for holding the handle 22 in position.

An elongated strap 46 has a first end 48 and a second end 50. A tubular member 52 is attached to the strap 46 and is positioned generally between the first 48 and second 50 ends. The pole 14 extends through the tubular member 52 such that the tubular member 52 is slidably mounted on the pole 14 and may be selectively positioned along a length of the pole 14. A coupler 54 is attached to the first end 48 of the strap 46 for selectively securing the first end 48 of the strap 46 to the second end 50 of the strap 46. The strap 46 may be selectively positioned around and secured to a chest of the person 5.

In use, the device 10 is used primarily used as a means covering the torso of a person 5 with an umbrella without the person using their hands. The handle 22 is attached to a belt 6 as shown in FIG. 1 so that the pole extends 14 upwardly from the belt 6. The person 5 may place a vest or jacket on so that the pole 14 is positioned between the vest and the person 5. The vest will then keep the umbrella 12 upright without the aid of the strap 46. If a vest or jacket is not worn over the pole 14, the person may use the strap 46 to aid in supporting of the umbrella 12 in a vertical orientation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella holding system for removably holding an umbrella in an upright position to a person, said system including:

an umbrella including a pole having a bottom end and a top end, a canopy being attached to the top end of the pole; and a handle being attached to the bottom end of the pole and extending downwardly away therefrom, said handle having a bottom side, a top side and a peripheral side wall extending between said top and bottom sides, said handle being substantially solid, a securing member for releasably attaching said handle to a belt being positioned on said handle a strap being elongated and having a first end and a second end, a tubular member being attached to said strap and being positioned generally between said first and second ends, said pole extending through said tubular member such that said tubular member may be selectively positioned along a length of said pole, wherein said strap may be selectively positioned around and secured to a chest of the person, a coupler being attached to said first end of said strap for selectively securing said first end of said strap to said second end of said strap.

2. The umbrella holding system of claim 1, wherein said securing member is formed by a slit transversely extending through said bottom side such that said slit extends through peripheral side wall and a first portion and a second portion of said bottom side is defined, wherein a belt positioned around the person may be extended into said slit.

3. Then umbrella holding system of claim 2, wherein said slit extends at least one inch upwardly from said bottom side.

4. Then umbrella holding system of claim 3, wherein said first portion has a smaller surface area than said second portion, said bottom side having a generally circular shape.

5. Then umbrella holding system of claim 2, wherein said first portion has a smaller surface area than said second portion, said bottom side having a generally circular shape.

6. Then umbrella holding system of claim 1, wherein said securing member comprises an L-shaped hook having a first end attached to said peripheral side wall such that said hook extends downwardly away from said pole.

7. An umbrella holding system for removably holding an umbrella in an upright position to a person, said system including:

an umbrella including a pole having a bottom end and a top end, a canopy being attached to the top end of the pole;

a handle being attached to the bottom end of the pole and extending downwardly away therefrom, said handle having a bottom side, a top side and a peripheral side wall extending between said top and bottom sides, said handle being substantially solid, a securing member for releasably attaching said handle to a belt being positioned on said handle, said securing member being formed by a slit transversely extending through said bottom side such that said slit extends through peripheral side wall and a first portion and a second portion of said bottom side is defined, said slit extending at least one inch upwardly from said bottom side, said first portion having a smaller surface area than said second portion, said bottom side having a generally circular shape, wherein a belt positioned around the person may be extended into said slit; and a strap being elongated and having a first end and a second end, a tubular member being attached to said strap and being positioned generally between said first and second ends, said pole extending through said tubular member such that said tubular member may be selectively positioned along a length of said pole, a coupler being attached to said first end of said strap for selectively securing said first end of said strap to said second end of said strap, wherein said strap may be selectively positioned around and secured to a chest of the person.

* * * * *